United States Patent [19]

Whitten et al.

[11] 4,372,756

[45] Feb. 8, 1983

[54] TWO-STAGE COAL GASIFICATION PROCESS

[75] Inventors: Charles M. Whitten, Brentwood; Robert H. Scott, Columbia; Vaughn Mansfield, Gallatin, all of Tenn.

[73] Assignee: Mansfield Carbon Products, Inc., Nashville, Tenn.

[21] Appl. No.: 278,992

[22] Filed: Jun. 30, 1981

[51] Int. Cl.[3] ..... C10J 3/00

[52] U.S. Cl. ..... 48/202; 48/210; 48/203; 48/206; 201/9; 201/32

[58] Field of Search ..... 48/202, 203, 206, 210, 48/86 R; 201/32, 34, 36, 37, 38, 27, 29, 18, 9

[56] References Cited

U.S. PATENT DOCUMENTS

| | | | |
|---|---|---|---|
| 2,140,276 | 12/1938 | Alther | 201/37 |
| 2,627,455 | 2/1953 | Berg | 48/206 |
| 2,925,334 | 2/1960 | Henze et al. | 48/86 R |
| 4,109,590 | 8/1978 | Mansfield | 48/206 |

FOREIGN PATENT DOCUMENTS

| | | | |
|---|---|---|---|
| 581692 | 10/1946 | United Kingdom | 110/31 |
| 1570002 | 6/1980 | United Kingdom | 48/210 |

*Primary Examiner*—Peter F. Kratz
*Assistant Examiner*—Michael L. Goldman
*Attorney, Agent, or Firm*—Littlepage & Webner

[57] ABSTRACT

Coal is processed first through a moving bed reactor and then through a fixed bed reactor. Hot carbonized coal char is fed from the first stage reactor to the second stage reactor via a lock hopper and gas is taken off from the reactors either in separate streams or in a common stream.

2 Claims, 1 Drawing Figure

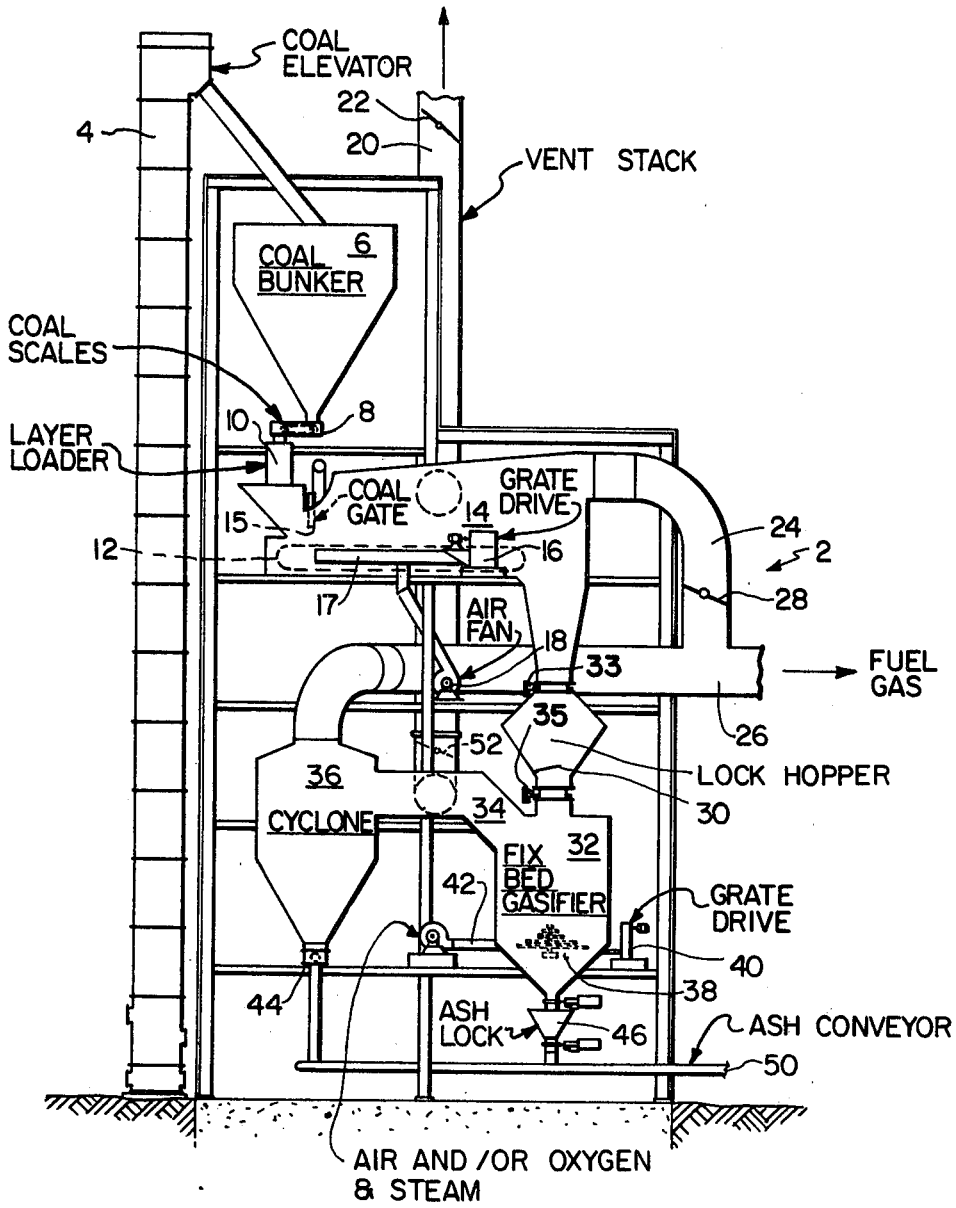
COAL ELEVATOR
22
20
VENT STACK
4
COAL BUNKER 6
COAL SCALES
8
10
LAYER LOADER
COAL GATE
GRATE DRIVE
14
15
16
12
24
2
28
17
AIR FAN
18
33
FUEL GAS
35
26
52
LOCK HOPPER
36
30
34
CYCLONE
32
FIX BED GASIFIER
42
GRATE DRIVE
40
38
44
ASH LOCK
46
ASH CONVEYOR
50
AIR AND /OR OXYGEN & STEAM

TWO-STAGE COAL GASIFICATION PROCESS

FIELD OF INVENTION

DISTILLATION PROCESSES THERMOLYTIC in class 201

PRIOR ART

U.S. patents; Alther U.S. Pat. No. 2,140,276, and Mansfield U.S. Pat. No. 3,146,175; British Pat. No. 581,692—Bailey

BACKGROUND AND OBJECTS

Gasification of coal in fixed bed reactors is well-known. The British patent to Bailey (supra) discloses coal gasification first in a moving bed reactor and then in a fixed bed reactor. Although a fixed bed reactor provides for virtually complete gasification of coal, it is subject to certain limitations, one being that agglomerating or caking coals that have Free Swelling Indexes in excess of three cannot be tolerated, and another being that agglomerating coal sized with more than 20% by weight of less than ¼ inch cannot be used. The object of this invention is to provide a process wherein coals having Free Swelling Indexes in excess of three and up to nine are first processed through a moving bed reactor so as to produce hot non-agglomerating char of substantially larger size than it was as raw feed stock for the fixed bed reactor.

If the agglomerating coal containing more than 20% minus ¼ inch size is fed to a conventional fixed bed reactor, the air and/or oxygen and steam fed to the reactor and the gases produced by the reaction cannot uniformly permeate the bed, and gas production rate and heating value thereby diminish to unacceptable levels. Channelization of the gases occurs and the resultant non-uniform bed causes further operating difficulties to the point of making the operation unfeasible. According to the subject process, however, agglomerating coals containing up to 70% of minus ¼ inch size can be charged into the first stage reactor and, with proper placement and distribution of air and/or oxygen and steam through the bed, char lumps are produced so as to provide properly sized feed stock for the second stage reactor.

While Bailey (supra) discloses gas take-off from a fixed bed gasifier which is fed with hot coke falling from a moving bed reactor, certain inherent problems limit the transportation of the gas output to a very short distance without cooling the gas and forcing the cooled gas with a fan. The moving bed reactor is normally operated at about atmospheric pressure and hence it was impossible to pressurize the fixed bed reactor without pressurizing the moving bed reactor. The object now is to provide for feeding hot char from a moving bed reactor through a lock hopper which permits the moving bed reactor to operate at about atmosphere pressure and the fixed bed reactor to be pressurized to as to force the gas produced therein to a remote device. For versatility is is intended to provide for deriving the gas outputs from the first and second stage reactors either in a single common stream or in separate mutually exclusive streams.

These and other objects will be apparent from the following specifications and drawings in which the single FIGURE is a diagram of a plant for performing the subject process.

Referring now to the drawing, the essential elements of a two-stage gasifier plant are shown. They are all of conventional construction and the operations of the individual elements are well-known. The invention is concerned with the method which makes it possible to use small size agglomerating coals with comparatively high Free Swelling Indexes as feed stock. The individual components and their general operation will first be described.

Raw coal, which may contain more than 20% minus ¼ inch sizes and which are of the agglomerating or caking type having a Free Swelling Index in excess of 3 is fed via elevator 4, bunker 6, and scales 8 to a layer loader 10 and there onto a horizontal chain grate 12 in the chamber of a moving bed reactor. The coal is spread onto the chain grate by means of a coal gate 15 to produce a bed on the grate ranging from 4½ inches to 30 inches. The chain grate is driven by a drive 16 at a controlled rate. As an example, Sewanee coal found in Tennessee having a Free Swelling Index of 7½ and containing 60% minus ¼ inch sizes was charged into the first stage reactor i.e., the moving bed furnace 14. On dry basis, this starting material consisted of about 8% ash, 28% volatile matter, and about 64% fixed carbon. In the fixed bed reactor the starting material reacted at a temperature of about 1800° F. to produce carbon containing about 10% minus ¼ inch size and 4% volatile matter for charging into the second stage reactor described below. Air or oxygen and steam is provided to the air box 17 by means of an air fan 18 or other suitable air and/or gas feed device. Low BTU gas may be derived from the furnace chamber by means of a stack 20 controlled by damper 22. Alternatively, gas from the first stage reactor 14 may be taken off via a gas outlet 24 leading to the gas output pipe 26. Flow of gas through gas outlet 24 is controlled by a damper 28 so that, during one mode of operation of the plant, gas outlet 24 may be closed by damper 28 and stack 20 opened by damper 22 so that the gas output from the first reactor may be fed to a utilization device independently of the gas output from the fixed bed gasifier 32 described below. Alternatively, if the gas from the fixed bed reactor is not to be fed to a remote utilization device, and if the two gases may be mixed damper 22 may be closed and damper 28 opened so that the gas output from the first stage reactor 14 is combined in a common stream with the gas output of the fixed bed gasifier 32.

Char dropping off the end of chain grate 12 flows through a lock hopper 30 from which it enters as feed stock to the fixed bed gasifier 32. Lock hopper 30, when damper 28 is closed, isolates the atmosphere of the fixed bed gasifier 32, from the atmosphere of the moving bed first stage reactor 14 by operation of valves 33, 35. The gas output from fixed bed gasifier 32 flows through an outlet 34 to a cyclone separator 36, where it is stripped from ash or other solid particulate matter and thence fed the output pipe 26 to a utilization device.

Preferably the fixed bed gasifier 32 has a rotary grate 38 driven by a grate drive 40. Air and/or oxygen and steam is fed into the lower portion of fixed bed gasifier 32. The cyclone separator and fixed bed gasifier are provided with a conventional ash valve 44 and an ash lock 46, the ashes from which are discharged via an ash conveyor 50. Other sealing devices may be used. Under certain conditions, for example for start-up, gas may be vented from the cyclone 36 via the stack 20 whose lower end is controlled by damper 52. For normal operation it will be assumed that the fuel gas from the fixed bed gasifier 32 is to be piped to a utilization device which is remote from the subject plant. Because the first stage reactor, 14 is normally operated at atmospheric pressure (enough to prevent air from leaking into the furnace chamber) at atmospheric pressure and because in order to feed the gas output from the gasifier to a remote utilization device is necessary to operate the fixed bed gasifier 32 under pressure, the atmospheres of the first stage reactor 14 i.e., the chain grate furnace must be isolated from the atmosphere of the fixed bed gasifier 32. To do this, damper, 28, and 52 are closed and the char output of the first stage reactor is charged into the fixed bed gasifier 32 via lock hopper 30.

Fixed bed gasifiers can tolerate very little material below ½ inch in size. Therefore, for successful gasification in the second stage, the coke produced in the first stage must be nominally larger than ½ inch. Coke of this size will not form a positive seal where, as in Bailey (supra) the coke from the moving bed reactor is charged directly into the fixed bed reactor. For applications where the fixed bed gasifier is to be operated at a higher pressure, positive sealing between the two stages provided by the lock hopper is necessary.

The need for separating the gases produced by the first stages of the gasification process for some applications has been previously recognized. This is primarily because the gases produced in the two stages can have appreciably different qualities with some coals under certain operating conditions. In some instances the gas produced in the first stage reactor may not have the heating value high enough to be suitable for widespread application other than direct firing into an adjacent combustion chamber. The second stage of this process can be operated at significantly higher pressures than can the first stage. No known commercial installations have been successful in operating traveling grates at pressures significantly higher than atmospheric. However, fixed bed gasifiers like the second stage of this process, are commonly operated at pressures from 6 psi to 8 psi; higher pressures are possible with special designs. Operating the second stage at higher pressure gives the capability to deliver the hot second stage gas to a remote location without having to cool the gas and pass it through a pressure boosting fan. Higher pressures can also increase the heating value of the gas produced.

The bed depth in the second stage or fixed bed gasifier 32 is controlled primarily by the lock hopper control valves, the speed of the first stage grate and the flow rate of the air-steam mixture added to the second stage. This flow rate controls the rate which the fuel in the second stage gasifier is gasified. Secondary control of the level in the second stage can be accomplished by the rate of ash removal from the second stage. However, ash removal must be used primarily to control the depth of the ash layer in the second stage and the location of the fire zone in the fixed bed gasifier.

Fixed bed reactors that are charged with coals having volatile content in excess of 12% will generate tars and oils as a result of distillation. In many cases the tars are not desirable and become an environmental liability. The tars can be removed from the product only by extensive gas cleaning steps. However, with the subject two stage gasification process, the proper control of air and/or oxygen and steam to the first stage reactor will result in temperatures that will crack the tars and oils to carbon monoxide, hydrogen and carbon thereby avoiding the production of undesirable materials. This is accomplished because the gasification reactions take place from the top of the bed downward toward the grate so that the tars and oils evolved by distillation must pass upward through incandescent carbon and are thereby reacted gases formed. This is opposed to conventional fixed bed reactors, wherein the gases evolved pass upwardly through the cold incoming material. The preferred method will result in a carbon feed to the second stage that contains less than 12% volatile matter; and the feeding of the hot incandescent carbon into the top of the fixed bed gasifier avoids condensation of the upwardly evolving gases onto the feed stock of the second stage reactor, which heretofore has been a problem where the feed stock is cold.

For most coals the addition of steam to the undergrate zone of the first stage is desirable. Steam will control reaction temperatures and can increase the heating value of the first stage gas. Steam, gas, or water can also be added to protect the upper and lower gates of the lock hopper, although it is preferred that feed stock for the fixed bed gasifier should be hot enough to prevent condensation on the upwardly evolving gases onto it.

In operating a fixed bed reactor into which cool coal is fed, there is a start-up problem, usually requiring 12 to 36 hours to reach stable operating conditions and the desired gasification rate. With the subject process, it is only necessary to put into the fixed bed reactor a layer of ash to protect the grate, after which hot coke from the first stage is dropped into the fixed bed reactor and the process starts immediately.

We claim:

1. A two stage process for gasifying agglomerating coal having a Free Swelling Index of from 2 to 9, volatile matter greatly in excess of 4% and consisting of more than 20% of minus ¼ of an inch, which comprises, producing hot char with substantially no more than 15% of minus ¼ of an inch and containing no more than 12% volatile matter by carbonizing said coal in a horizontally moving bed reactor having a chamber at or only slightly above atmospheric pressure by reacting said coal with gas selected from the group consisting of air, oxygen and steam until the bed temperature is raised to between 1200° F. and 1800° F. and most of the tar and oil content of the coal is cracked to essentially carbon monoxide and hydrogen while leaving a hot char residue consisting essentially of carbon and minor amounts of volatile matter and ash, gravity feeding said hot char through a gas lock hopper into a fixed bed reactor having a chamber disposed below and isolated from the chamber of the moving bed reactor by the gas lock hopper, said fixed bed reactor having a gas outlet conduit leading to a remote utilization device, and reacting said hot char in the fixed bed reactor with a gas consisting of air or oxygen and steam at a pressure substantially above atmospheric pressure and sufficient to force the gaseous reaction by-product from the fixed bed reactor chamber through the gas outlet conduit to the remote utilization device.

2. A process as claimed in claim 1, wherein the agglomerating coal, prior to carbonization, is sized with more than 20% of minus ¼ of an inch, and after carbonization is sized no more than 15% of minus ¼ of an inch.

* * * * *

UNITED STATES PATENT AND TRADEMARK OFFICE

CERTIFICATE OF CORRECTION

PATENT NO. : 4,372,756

DATED : February 8, 1983

INVENTOR(S) : Charles M. Whitten, et al.

It is certified that error appears in the above-identified patent and that said Letters Patent is hereby corrected as shown below:

In Column 1, line 59, delete "to", second occurrence insert --so--.

In Column 2, line 2, after "plant", insert --2--.

In Column 2, line 57, after "fed", insert --through--.

In Column 3, line 5, delete "at atmospheric pressure".

In Column 3, line 7, after "device", insert --it--.

In Column 3, line 11, delete "damper", insert --dampers--.

In Column 4, line 6, after "reacted", insert --and--.

In Column 4, line 23, delete "on", insert --of--.

Signed and Sealed this

*Third* Day of *May 1983*

[SEAL]

*Attest:*

GERALD J. MOSSINGHOFF

*Attesting Officer*

*Commissioner of Patents and Trademarks*